US008171686B1

(12) United States Patent
Bao

(10) Patent No.: US 8,171,686 B1
(45) Date of Patent: May 8, 2012

(54) STARTER COURSE FOR EXTERIOR INSULATION PANELS

(75) Inventor: Rafael Bao, Montreal (CA)

(73) Assignee: 9171-6803 Quebec Inc., Marco Polo, Montreal, PQ (CA)

( * ) Notice: Subject to any disclaimer, the term of this patent is extended or adjusted under 35 U.S.C. 154(b) by 0 days.

(21) Appl. No.: 12/968,267

(22) Filed: Dec. 14, 2010

(51) Int. Cl.
*E04B 1/70* (2006.01)

(52) U.S. Cl. ..... 52/302.1; 52/302.3

(58) Field of Classification Search ..... 52/302.1, 52/302.3, 302.4
See application file for complete search history.

(56) References Cited

U.S. PATENT DOCUMENTS 5,473,847 A * 12/1995 Crookston ..... 52/302.1
5,564,243 A * 10/1996 Kroll et al. ..... 52/506.1

* cited by examiner

*Primary Examiner* — Jeanette E Chapman
*Assistant Examiner* — Daniel Kenny

(57) ABSTRACT

The present invention provides for a starter course for an exterior insulation panel application. The starter course has an outer surface, an inner surface, a lower edge, an upper edge and side edges. The outer surface is generally planar. The inner surface is provided with raised structures to provide drainage channels there between, the raised structures being provided over at least the upper half of the inner surface of the starter course. The raised structures extend across the starter course from one side edge to the other and from the upper edge to at least half way to the lower edge. The portion of the inner surface from the lower edge upwardly to about half way to the upper edge is free of the raised structures.

5 Claims, 4 Drawing Sheets

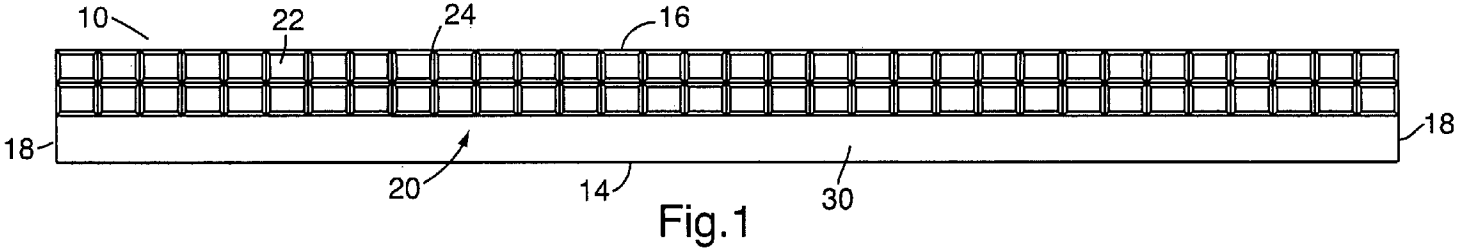
Fig.1
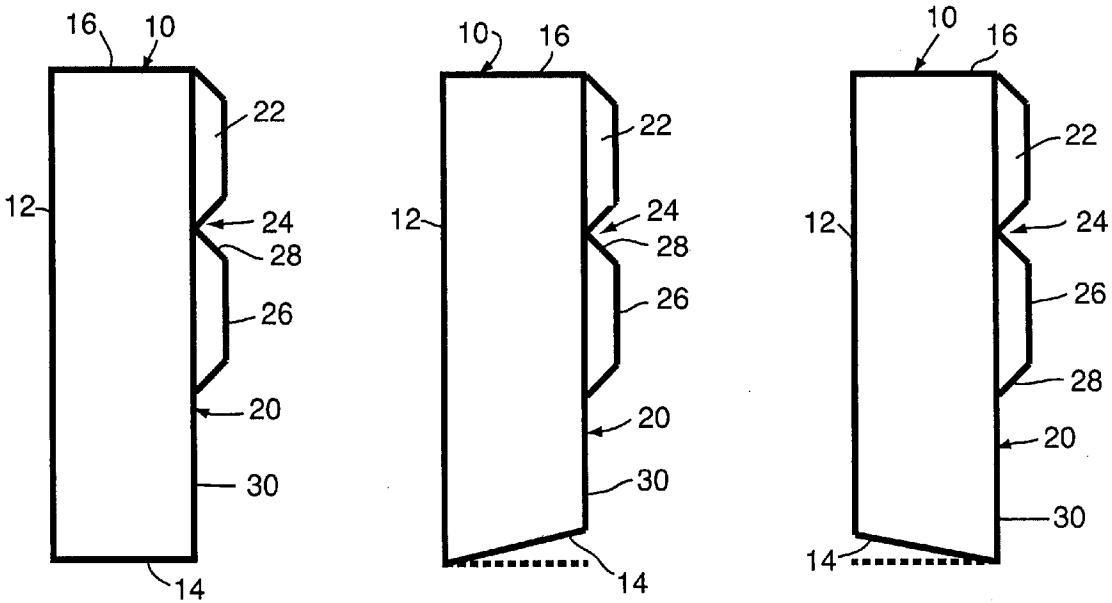
Fig.2
Fig.3A
Fig.3B

STARTER COURSE FOR EXTERIOR INSULATION PANELS

FIELD OF THE INVENTION

The present invention is directed to starter courses for exterior insulation panels and in particular starter courses which simplify the installation process and result in increased strength at high stress areas.

BACKGROUND OF THE INVENTION

Exterior insulation panels are commonly employed in construction, particularly in commercial and industrial construction. In such applications the exterior insulation panels are applied over a layer of sheathing material which is normally applied to the exterior of a building under construction. In order to provide for proper drainage, it is common in the art to provide the rear surface of the insulation panel with drainage channels such as vertical grooves. The rear surface of the panel may also be provided with horizontal grooves to allow for air circulation and help improve the drainage. This can result in the rear surface having a box or diamond pattern.

The outer surface of the insulation panel is generally finished with a stucco like finish to provide an exterior insulation and finish system (EIFS). A base coat is first applied over the insulation panel by spraying or towelling. A mesh layer is then embedded in the wet base coat by towelling and an additional base layer may then be applied over the mesh layer. Once the base coat dries, one or more finish coats are then applied to the outer surface to provide the finish desired.

The covering of the wall by the insulation panels is generally started at the lower edge of the wall. Any exposed edges of the insulation panel must be wrapped along the edge and part way up the inner surface by a base coat and mesh layer as described above. This seals the edges of the panel and reduces the possibility of the finish surface cracking at the edges as it is supported by the wrapped base and mesh layers. Similarly, exposed edges of the insulation panel around openings such as for doors and windows also have to be wrapped. It has been found however, that as this is a tedious and labour intensive step, it is common in the field for installers to either skip the wrapping steps or to not wrap around to the inner surface. One reason for this is that it is difficult to wrap around to the inner surface if the inner surface has been attached to the sheathing material. The installer must loosen the inner surface from the building in order to wrap the inner surface, then reattach the edge of the panel to the building. If the edges and inner surface are not wrapped, it can result in deterioration of the edges of the insulation panel as well as cracking or fracturing of the final finish coats due to exposure to the elements.

There thus remains a need for simple to install starter course which provides for ease in wrapping the edges and inner surface of the insulation panel.

SUMMARY OF THE INVENTION

The present invention provides for a starter course for an exterior insulation panel application. The starter course has an outer surface, an inner surface, a lower edge, an upper edge and side edges. The outer surface is generally planar. The inner surface is provided with raised structures to provide drainage channels there between, the raised structures being provided over at least the upper half of the inner surface of the starter course. The raised structures extend across the starter course from one side edge to the other and from the upper edge to at least half way to the lower edge. The portion of the inner surface from the lower edge upwardly to about half way to the upper edge is free of the raised structures.

In an aspect of the invention, the raised structures are generally square in shape to provide vertical and horizontal drainage channels there between.

In another aspect of the invention, the raised structures are generally diamond shaped to provide drainage channels there between.

In a further aspect of the invention, the starter course is for an outside edge for use at a lower corner of a door opening, the starter being generally L shaped with the inner surface being provided with the raised structures from the inner edges of the L shape to about half way to the outer edges of the L shape.

In yet another aspect of the invention, the starter course is for an inside edge for use at an upper corner of a door opening or a corner of a window opening, the starter course being generally L shaped with the inner surface being provided with the raised structures from the outer edges of the L shape to about half way to the inner edges of the L shape.

In another aspect of the invention, the starter course is pre wrapped with a base coat and a mesh layer embedded in the base coat, the prewap extending from about half way up the outer surface around the lower edge and up the inner surface which is free of the raised structures.

BRIEF DESCRIPTION OF THE DRAWINGS

Preferred embodiments of the present invention are illustrated in the attached drawings in which:

FIG. 1 is a rear plan view of an embodiment of a starter course of the present invention for use along an edge of a wall or opening;

FIG. 2 is a side elevation view of the starter course of FIG. 1;

FIGS. 3A and 3B are side elevation views of variations of the starter course of FIG. 1;

DETAILED DESCRIPTION OF THE PREFERRED EMBODIMENTS

Figure 5:
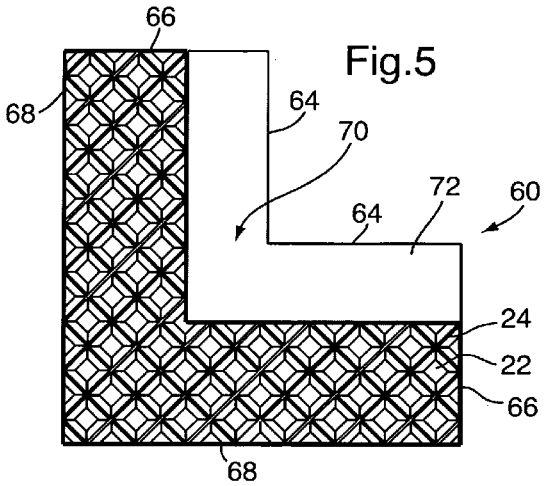
FIG. 5 is a rear plan view of an embodiment of a starter course of the present invention for use at an inside edge of an opening.

An embodiment of a starter course of the present invention for use along an edge of a wall is illustrated in the figures generally indicated by the numeral 10. Starter course 10 has a generally planar outer surface 12, a lower edge 14, upper edge 16, side edges 18, and an inner surface 20. Inner surface 20 is provided with raised structures 22 which extend from the inner surface 20. Drainage channels 24 are provided between the raised structures 22 to allow for drainage of any moisture within the wall cavity as is common in the art. The raised structures 22 illustrated in the FIGS. 1 to 3 are generally square in shape with a planar top surface 26 and outwardly sloping side edges 28 which extend toward the inner surface 20 of the starter course 10. This provides V shaped drainage channels 24 between the raised structures 22. While the raised structures 22 are illustrated as being square shaped, it will be appreciated by those of skill in the art that other shapes such as rectangular, circular, diamond, etc., are possible.

As illustrated in the figures, the raised structures 22 extend from the upper edge 16 across the inner surface 20 to at least half the distance to the lower edge 14. More preferably, the raised structures 22 extend across at least 60% of the inner surface 20 from the upper edge 16. The portion 30 of the inner surface 20 from the lower edge 14 upwardly to the raised structures 22 is free of raised structures to allow for wrapping of the lower edge of the starter course 10 as will be described below.

The starter course 10 illustrated particularly in FIGS. 1 to 3 is for use along an edge of the wall and typically would be 8 feet in length as this is the length of the insulation panels commonly in use. It is preferred if the height of the starter course 10 is a fraction of the typical width of the insulation panel which is commonly 4 feet. Preferably, the height of the starter course 10 is between 8 and 16 inches, most preferably 8 inches. The thickness of the starter course will be the same thickness as the insulation panels, preferably 1.5 or 2 inches in thickness. These dimensions of the starter course 10 allow for ease of installation of the insulation panels on the exterior wall.

In some situations, particularly where the starter course 10 is being installed at floor surfaces or where flashing is to be installed, it is preferred if the lower edge 14 is not square but slopes either inwardly or outwardly. These variations are illustrated in FIGS. 3A and 3B. The lower edge 14 preferably is provided with about a 10° slope as illustrated in the figure. The embodiment of FIG. 3A which slopes downwardly at a 10° angle from the inner surface 20 to the outer surface 12 would generally be used where a flashing will be installed whereas the embodiment of FIG. 3B would generally be used to abut a floor surface.

Figure 4:
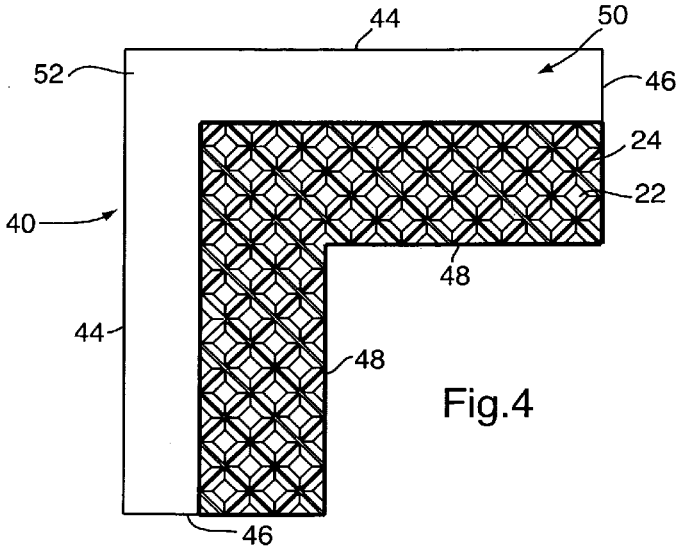
FIG. 4 is a rear plan view of an embodiment of a starter course of the present invention for use at an outside edge of an opening.

An embodiment of the starter course of the present invention for use at outside edges of an opening is illustrated in FIG. 4 generally indicated by the numeral 40. This embodiment of the starter course is generally L shaped having a planar outer surface 42, outer edges 44, side edges 46, inner edges 48 and an inner surface 50. In this embodiment, the outer edges 44 line up with the lower edges 14 of the starter course 10 and the inner edges 48 line up with the upper edges 16 of the starter course 10. Inner surface 50 is provided with raised structures 22 which extend from the inner surface 50. In this embodiment, the raised structures are illustrated as diamond shaped, although they may be of other shapes, such as square, rectangular, circular, etc. to match the shaping of the raised structures on the insulation panels. Drainage channels 24 are provided between the raised structures 22 to allow for drainage of any moisture within the wall. The raised structures 22 extend from the inner edge 48 across the inner surface 50 to at least half the distance to the outer edge 44. More preferably, the raised structures 22 extend across at least 60% of the inner surface 50 from the inner edge 48. The portion 52 of the inner surface 50 from the outer edge 44 to the raised structures 22 is free of raised structures to allow for wrapping of the outer edge 44 of the starter course 40 as will be described below.

An embodiment of the starter course of the present invention for use at inside edges of an opening is illustrated in FIG. 5 generally indicated by the numeral 60. This embodiment of the starter course is generally L shaped having a planar outer surface 62, outer edges 64, side edges 66, inner edges 68 and an inner surface 70. In this embodiment, the outer edges 64 line up with the upper edges 16 of the starter course 10 and the inner edges 68 line up with the lower edges 14 of the starter course 10. Inner surface 70 is provided with raised structures 22 which extend from the inner surface 70. In this embodiment, the raised structures are diamond shaped. Drainage channels 24 are provided between the raised structures 22 to allow for drainage of any moisture within the wall. The raised structures 22 extend from the outer edge 64 across the inner surface 70 to at least half the distance to the inner edge 68. More preferably, the raised structures 22 extend across at least 60% of the inner surface 70 from the outer edge 64. The portion 72 of the inner surface 70 from the inner edge 68 to the raised structures 22 is free of raised structures to allow for wrapping of the inner edge 68 of the starter course 60 as will be described below.

Once the starter courses 10, 40 and 60 as required are installed on the wall, the insulation panels are then installed, and the insulation panels are wrapped with the base coat and mesh layer in the usual manner as will be described in further detail below. As the portion of the inner surface 20 at the lower edge 14 is free of raised structures 22, this portion of the inner surface does not directly abut the wall surface but rather has a gap. It is easier for an installer to place a base coat and a mesh layer within the gap against the inner surface to provide the proper wrapping of the lower edge.

Figure 6:
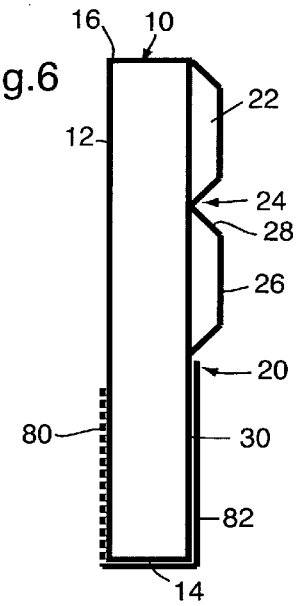
FIG. 6 is a side elevation view of the starter course of FIG. 1 which has been pre-wrapped.

Alternatively, as illustrated in FIG. 6, the starter course 10 may be provided pre-wrapped. Preferably, a mesh layer 80 is wrapped around the portion 30 of the inner surface 20 free of raised structures 22, the lower edge 14 and about half way up the outer surface 12. The mesh layer 80 may be adhesive backed to stick to the surfaces of the starter course 10 or it may be embedded in a thin layer of base coat. In either situation, once the mesh layer 80 is wrapped around the starter course 10, a base coat layer 82 is applied over the mesh layer covering the portion 30 of the inner surface 20 free of raised structures 22 and the lower edge 14. The mesh layer 80 on the outer surface 12 is left exposed to allow for a continuous base coat to the lower edge once the installer applies the mesh layer and base coat over the wall surface after all of the insulation panels are installed as will be described below. The corner starter courses 40 and 60 may also be pre-wrapped in a similar manner.

Figure 7:
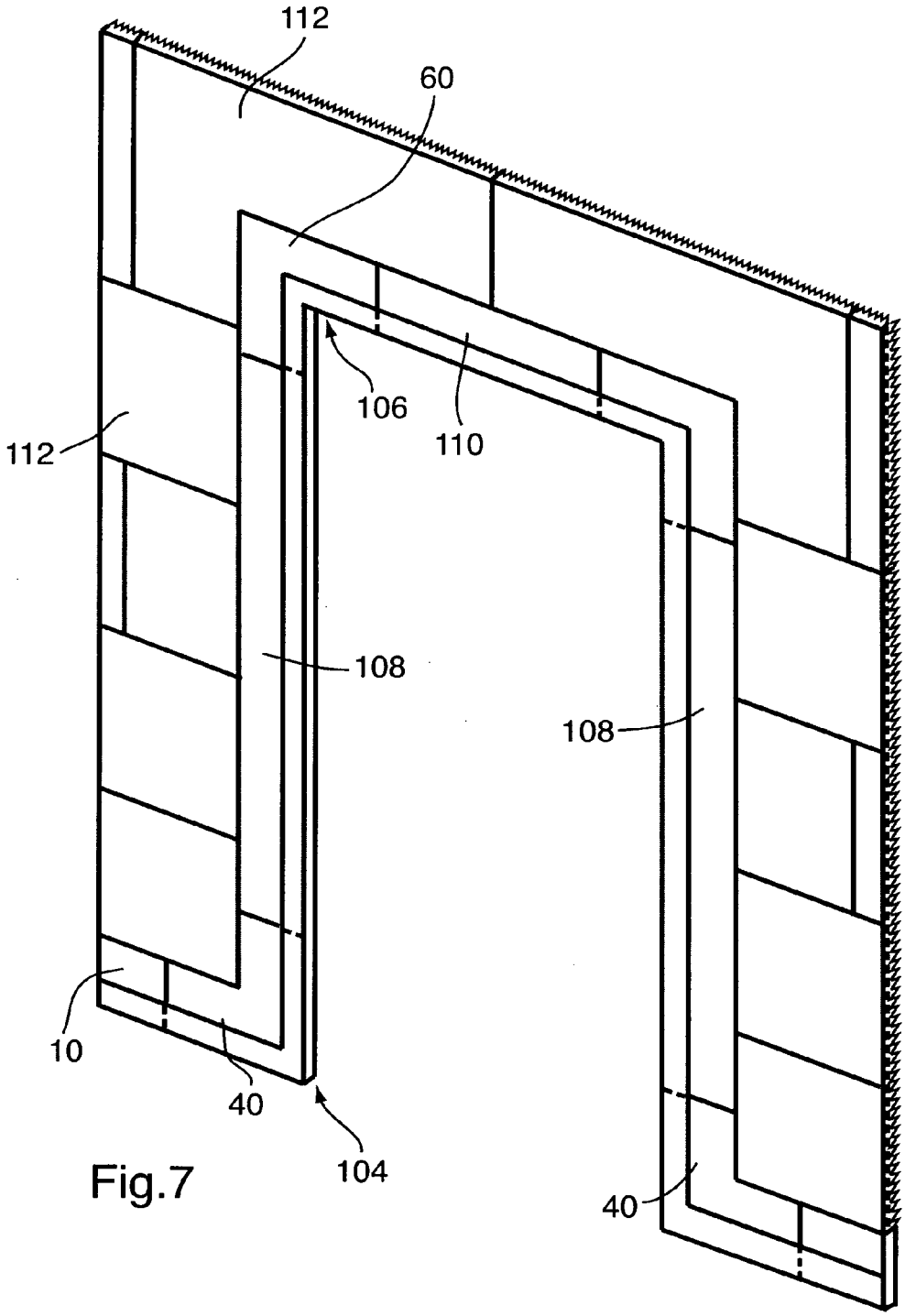
FIG. 7 is a perspective view of the starter courses of the present invention in use on an exterior wall of a building.
Figure 8:
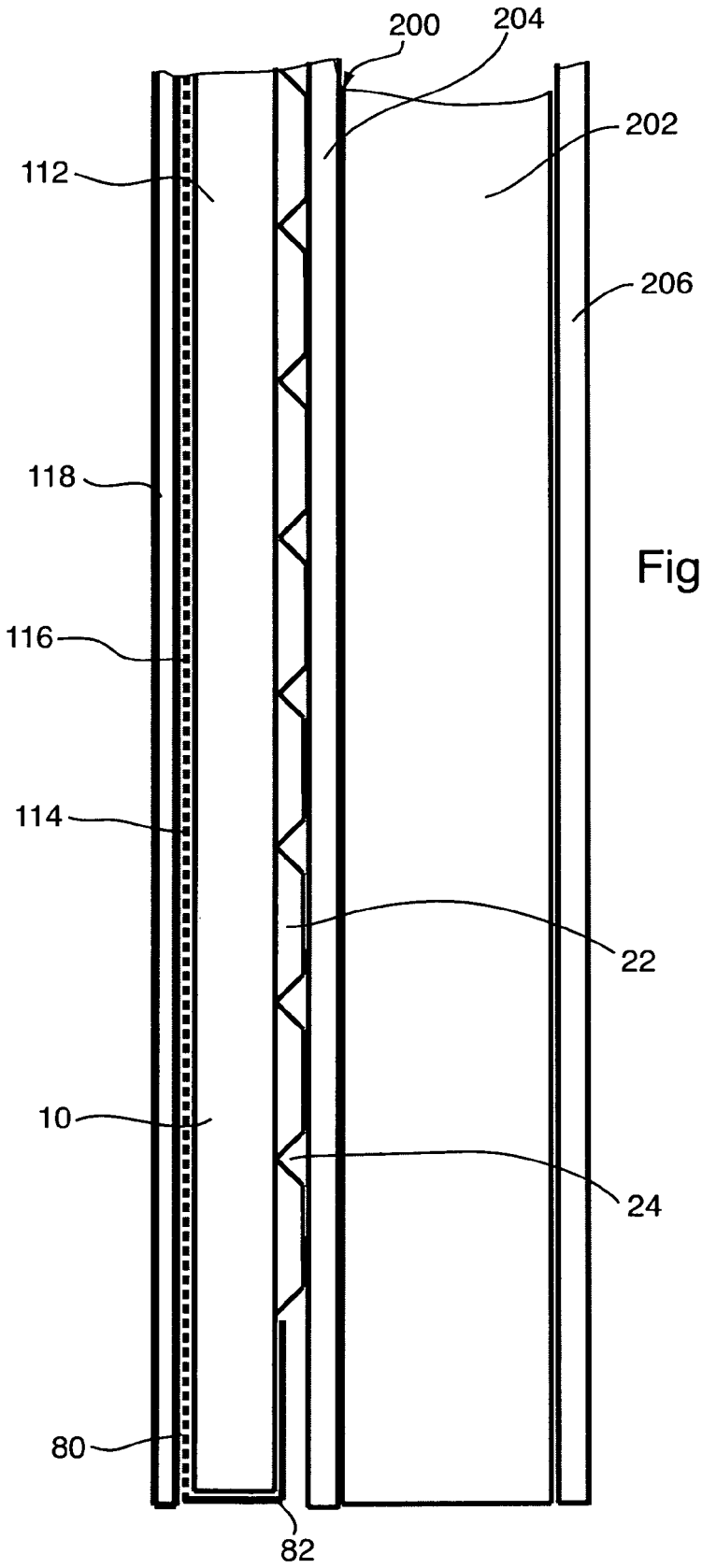
FIG. 8 is a side elevation view in cross section of the wall of FIG. 7.

The installation of the insulation panels of a wall using the starter courses of the present invention will now be described with reference to FIGS. 7 and 8. The starter courses 10 are installed along the lower edge of the wall 100 in the usual manner by attached them to the wall surface 200 by adhesive or other fasteners. A typical wall section is illustrated in FIG. 8 having studs 202 to which are attached exterior sheathing 204 and interior sheathing 206.

Where a door opening 102 is present, starter course 40 is installed at each of the lower corners 104, and starter courses 60 are installed at each of the upper corners 106. Sections of starter course 10 are them trimmed to length to fill the gaps between the starter courses 40 and 60 as well as between the two starter courses 60 at the upper corners as indicated by 108 and 110 respectively. In a similar manner a window opening can be covered by using starter courses 60 at each of the corners and filling the gaps there between with sections of starter course 10.

Once the starter courses 10, 40 and 60 are all installed, the insulation panels 112 are attached to the wall surface 200 in the usual manner butting against the starter courses. The insulation panel covered wall is then finished in the usual manner by applying the base coat 114, mesh layer 116, optionally additional base coat and then the finish coat 118 as shown in the cross section of a wall constructed using the starter courses of the present invention is illustrated in FIG. 8.

The starter course of the present invention provides for numerous advantages, particularly in the ease and reduced time required for finishing the exterior wall which has been covered with insulation panels. The starter courses make for easier wrapping around the edges, particularly when the starter courses are provided pre-wrapped. This ensures the structural integrity of the cladding and reduces the possibility of cracks and fractures of the finished surface particularly at high stress areas such as corners. The raised structures of the starter course match up with the raised structures used on the insulation panels thus preserving the drainage capacity of the wall. The starter courses facilitate the junctions of the EIFS with other surfaces such as masonry and siding. The starter courses of the present invention can also be used at floor lines where expansion joints are usually mandated.

While various preferred embodiments of the present invention have been described herein in detail, it will be appreciated by those of skill in the art that variations may be made thereto without departing from the spirit of the invention or the scope of the appended claims.

I claim:

1. A starter course for an exterior insulation panel application, the starter course comprising a generally planar outer surface, an inner surface, a lower edge, an upper edge and side edges, the inner surface being provided with raised structures to provide drainage channels there between, the raised structures being provided over at least the upper half of the inner surface of the starter course, the raised structures extending across the starter course from one side edge to the other and from the upper edge to at least half way to the lower edge, the portion of the inner surface from the lower edge upwardly to about half way to the upper edge is free of the raised structures, the starter course being pre wrapped with a base coat and a mesh layer embedded in the base coat, the pre wrap extending from about half way up the outer surface around the lower edge and up the inner surface which is free of the raised structures.

2. The starter course according to claim 1 wherein the raised structures are generally square in shape to provide vertical and horizontal drainage channels there between.

3. The starter course according to claim 1 wherein the raised structures are generally diamond shaped to provide drainage channels there between.

4. The starter course according to claim 1 wherein the starter course is for an outside edge for use at a lower corner of a door opening, the starter being generally L shaped with the inner surface being provided with the raised structures from the inner edges of the L shape to about half way to the outer edges of the L shape.

5. The starter course according to claim 1 wherein the starter course is for an inside edge for use at an upper corner of a door opening or a corner of a window opening, the starter being generally L shaped with the inner surface being provided with the raised structures from the outer edges of the L shape to about half way to the inner edges of the L shape.

* * * * *